United States Patent [19]

Cabrera

[11] Patent Number: 4,790,218

[45] Date of Patent: Dec. 13, 1988

[54] ROTARY SOCKET WRENCH

[76] Inventor: Leonel M. Cabrera, 12013 Alberts St., #12, North Hollywood, Calif. 91607

[21] Appl. No.: 122,759

[22] Filed: Nov. 19, 1987

[51] Int. Cl.[4] ..... B25B 17/00

[52] U.S. Cl. ..... 81/57.13; 81/57.29

[58] Field of Search ..... 81/57.13, 57, 57.11, 81/57.26, 57.27, 57.28, 57.25, 57.29, 57.14

[56] References Cited

U.S. PATENT DOCUMENTS

| | | | |
|---|---|---|---|
| 2,107,108 | 2/1938 | De mody | 81/57 |
| 2,808,749 | 10/1957 | Lampke | 81/57.13 |
| 4,171,651 | 10/1979 | Dacato | 81/57.29 |
| 4,505,170 | 3/1985 | VanLaure | 81/57.14 |

*Primary Examiner*—Frederick R. Schmidt
*Assistant Examiner*—Blynn Shideler
*Attorney, Agent, or Firm*—Albert O. Cota

[57] ABSTRACT

A socket wrench powered by an electric motor which has an enclosing housing (20) with a handle (22) and a motor (30) driving a gear cluster (34) and a mating driven gear train (46) reducing the rotational speed of the motor. A geared hub (58) interfaces with the gear train and rotates a removable socket (74) at right angles to the motor. The workpiece is positioned within the socket and is driven in either direction, as selected by the switch (88) and the speed of rotation is controlled manually by the variable resistance switch (86). The wrench allows a nut to be continuously driven along an extended shaft in controlled direction and speed.

8 Claims, 2 Drawing Sheets

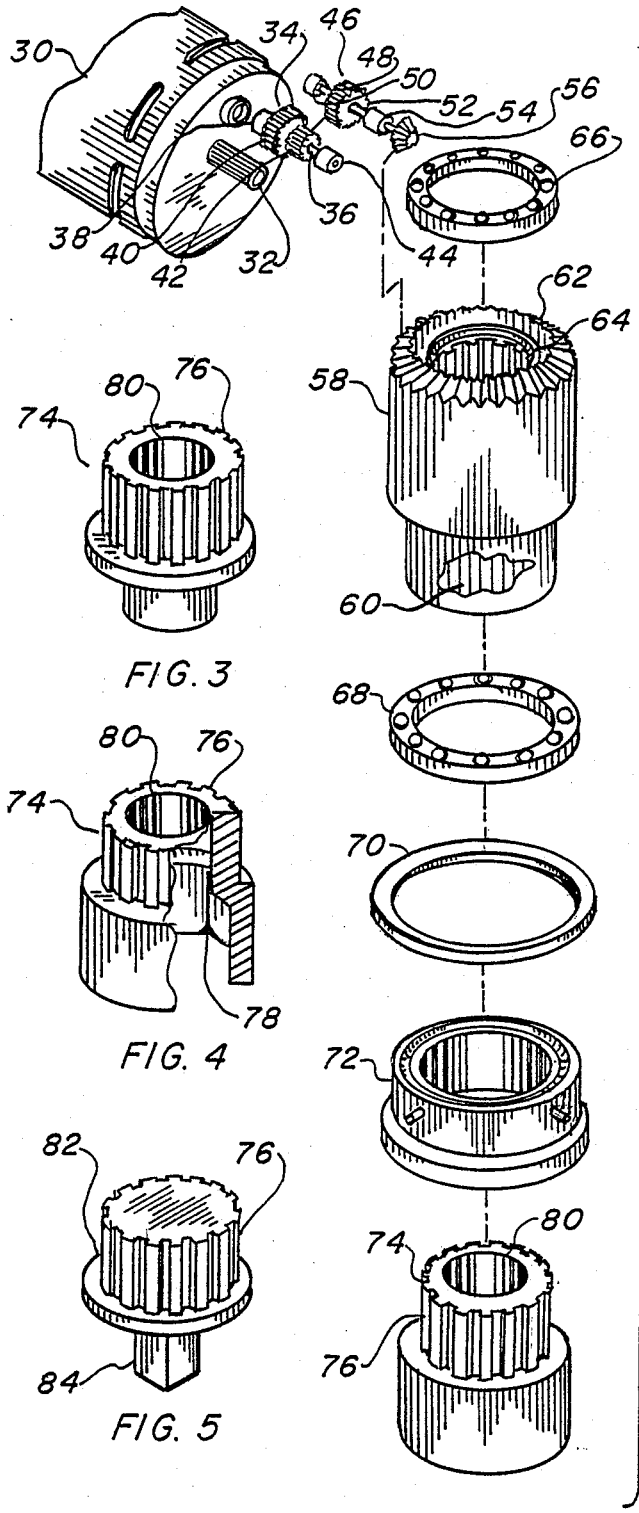
FIG. 6
FIG. 3
FIG. 4
FIG. 5
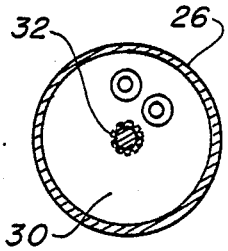
FIG. 7
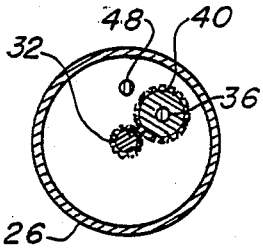
FIG. 8
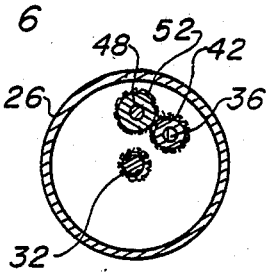
FIG. 9
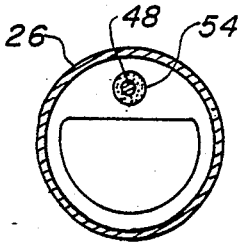
FIG. 10

ROTARY SOCKET WRENCH

TECHNICAL FIELD

The present invention relates to power operated hand held tools in general. More specifically to an electric motor driven, multispeed, right angled, rotary socket wrench.

BACKGROUND ART

Previously, many types and styles of power driven wrenches have been used in endeavoring to provide an effective means to drive a nut along an extended shaft. Some tools utilize open ended radial slots admitting the workpiece with a hexagonal socket to register with the nut. Others use splined gears to attach separate adapter tools for breakaway capabilities. Others use conventional drill motors to provide the electromotive force.

A search of the prior art did not disclose any patents that read directly on the claims of the instant invention, however, the following U.S. patents were considered related:

| Patent No. | Inventor | Issue Date |
|---|---|---|
| 4,322,989 | Garolis | Apr. 6, 1982 |
| 4,240,310 | Roth | Dec. 23, 1980 |
| 4,171,651 | Dacunto | Oct. 23, 1979 |
| 3,987,692 | Lesner et al | Oct. 26, 1976 |
| 3,791,242 | Bartusch | Feb. 12, 1974 |
| 3,257,877 | Ulrich et al | Jun. 28, 1966 |

Garolis discloses an electric motor, with a removable case, driving a shaft with a worm gear driving a ring gear. A coupling on the shaft allows the motor to be removed. The work engaging gear ring fits the work without the use of a compensating socket, however, the ring must be changed to the desired configuration.

Roth utilizes a socket wrench that has a holder containing a socket rotatably driven from a separate rotary power tool, such as an electric drill. The configuration is such that the device is thin enough to fit into closely confined spaces.

Dacunto teaches a power driven socket wrench that swivels about the axis of the output shaft. A single clamping screw locks the assembly in place, and the rotating socket contains an arcuate slot in the wrench housing for engaging the workpiece.

Lesner et al, on the other hand, employ an air motor for rotational force and use a similar slotted end socket member. The motor is reversible and a cluster of gears provide the speed reduction. One of the objects of this invention is to improve the method of re-registering the slots, which is accomplished by a combination of the reversing feature of the motor and detent means.

Bartusch is directed to an electric motor powered wrench with a connecting rod using a worm gear eccentric crankshaft mechanism. The connecting rod imparts successive rotational movements to a ratchet gear rotating the socket or an adapter for impacting actuation of the mechanism for breaking loose objects to be rotated.

Ulrich et al also use an air motor having a constant speed ratio initially, with automatic shifting into a different drive ratio during final stages of operation. This change in ratio is sensed by a preset torque valve changing the relationship of a planetary gear train.

It will be noted, however, that the combination of variable speed and reversible mode of operation has not been found in any of the prior art thus discovered.

DISCLOSURE OF THE INVENTION

While prior art has approached the problem of providing a wrench to drive a nut on an extended shaft they have not been able to completely achieve the ability to control the speed of the wrench and its related torque in respect to the varied applications while incorporating the reversing facility simultaneously.

It is, therefore, a primary object of the invention to provide a rotary socket wrench that will not only drive a nut or similar fastener on a deeply threaded stud or a continuous running thread, but operate at a variable speed in either direction. This is accomplished by the use of a reversible electric motor wound and controlled to vary the speed while maintaining the torque. While this motor is not new in the art, its use in the combination thus disclosed is indeed novel.

Another object of the invention allows its use is closely confined spaces as the extension beyond the motor itself is very small and the entire wrench is only slightly larger than the combined motor and socket interfacing with the workpiece.

Still another object of the invention allows the tool to be easily adapted to conventional drive systems by the use of socket adapters. These adapters may be sized to fit the standard drive sockets allowing the tool to be universal in nature. This allows the prime function to be realized utilizing the sockets that are hollow and stepped to fit both the nut and thread, and also, the conventional type when driving a nut on a bolt in a normal manner.

Yet another object of the invention is to provide a novel rotary wrench for sockets which totally cover the motor and incorporates bearings for long and trouble-free life.

Finally an object of the invention involves the provision of a novel motor operated wrench mechanism, which is simple by its very nature, therefore, reliable in operation and cost effective due to the minimum number of components.

Other objects and advantages of the invention include the following:

use in the house,
use in machine shops,
use in mechanic shops,
use in construction,
use in industry
use in production
saves energy,
saves money, and
saves time.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 3 is a partial isometric view of a stepped head socket cut-away to the centerline on one side.

FIG. 4 is a partial isometric view of a full head socket cut-away to the centerline on one side.

FIG. 5 is a partial isometric view of a socket adapter cut-away to the centerline on one side.

FIG. 6 is an exploded view of the rotary socket wrench with the housing and part of the motor deleted.

FIG. 7 is a cross-sectional view taken along lines 7—7 of FIG. 2.

FIG. 8 is a cross-sectional view taken along lines 8—8 of FIG. 2.

FIG. 9 is a cross-sectional view taken along lines 9—9 of FIG. 2.

FIG. 10 is a cross-sectional view taken along lines 10—10 of FIG. 2.

BEST MODE FOR CARRYING OUT THE INVENTION

Figure 1:
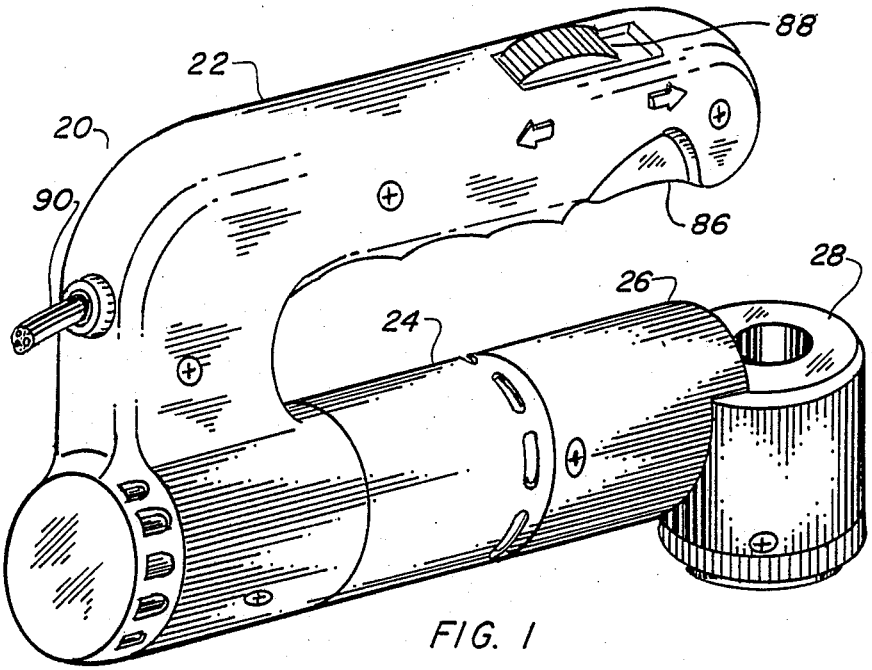
FIG. 1 is a partial isometric view of the preferred embodiment shown with a nut driving socket in place
Figure 2:
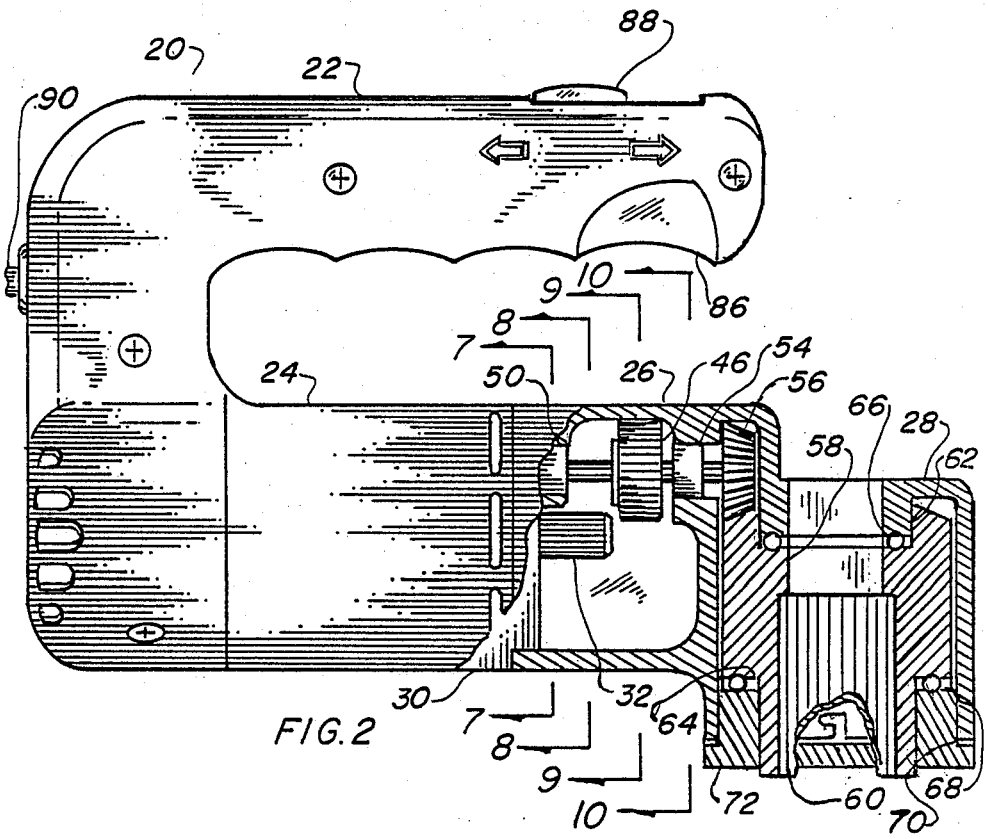
FIG. 2 is a partial side elevational view of the preferred embodiment with the gear retaining end cutaway exposing the elements within sectioned on the centerline of the invention.

The best mode for carrying out the invention is presented in terms of a preferred embodiment. The preferred embodiment, as shown in FIGS. 1 through 10 is comprised of a structural housing 20 with a handle 22 for enclosing and protecting elements that are located therein. This housing also provides the integrity of structure to retain rotating components. The handle 22 is shaped to conform to the users hand in a normal position at right angles to the workpiece, such as a nut on a threaded rod. The handle 22 is juxtapositioned over a motor retaining portion 24 at a clearance allowing ones fingers to easily grasp the handle 22 without interference, while providing a compact attractive package. The handle 22 is integrally attached to the motor portion 24 on one end forming the housing 20 into a "U" shape. The motor portion 24 is so configured to be receptive to an electric motor and the handle 22 is hollow allowing wiring to be positioned inside.

The housing 20 also contains a gear confining area 26 integrally extending from the motor portion 24 forming a hollow protective housing with reinforcing stiffeners for retaining bearings, and the like. Finally, the housing 20 includes a socket enclosing portion 28 at right angles to the gear area 26. This socket section defines the mechanical structure for supporting the rotary driven elements of the wrench.

The housing 20 may be fabricated of any material suitable for the purpose having sufficient structural integrity to withstand the torque of the motor and abuse of handling during operation and storage. This material may include steel, aluminum, zinc alloy, magnesium, ( etc., as well as thermoplastic compositions, such as ABS, cellulosics, phenolic, polypropylene, polyethylene, polycarbonate, and the like.

An electric motor 30 is utilized to supply the rotational torque to operate the wrench. The motor 30 is the so-called universal wound type that is variable in speed and reversible in rotation. This allows the wrench to rotate either clockwise or counterclockwise to either install or remove the nut, as required.

The motor includes a tooth geared cluster 34 is intermeshed. This drive gear cluster 34 is composed of a drive shaft 36, in which a first bearing 38 is positioned near one end. Next to the bearing 38 is a first drive gear 40 having mating teeth the same pitch as the motor shaft 32. The diameter of this first drive gear 40 is larger than the motor shaft 32, thereby reducing the speed of the shaft 36 relative to the motor 30. A second drive gear 42 is also located on the shaft 36 adjacent to the first gear 40 and smaller in diameter. Finally, a second bearing 44 is located on the other end of the shaft with both bearings 38 and 44 serving to reduce the rotational friction of the cluster 34 and to provide a structural bearing surface, as they are both retained in line by the housing 20.

A driven gear train 46 is located within the housing 20 adjacently parallel to the drive gear cluster 34. This gear train 46 has a similar driven shaft 48 with a third bearing 50 on one end. A driven gear 52 is intermeshed with the second drive gear 42 of the drive cluster 34 and is larger in diameter, again reducing the speed reduction ratio. A fourth bearing 54 is mounted on the driven shaft 48 adjacent to the bearing 54 with a beveled gear 56 affixed to the end. The bearings 50 and 54 are similarly retained within the housing 20 and serve the same purpose. All of the bearings may be the same type and may be oil impregnated, sintered bronze, or ball bearings with equal ease, or any other type suitable for the purpose.

A socket retaining geared hub 58 is disposed within the socket enclosing portion 28 of the housing 20 at a right angle to the motor shaft 32. The hub 58 has a female splined hollow 60 inside, with a driven beveled gear 62 on one end and a recessed shoulder 64 on the other. The driven beveled gear 62 matingly engages the drive beveled gear 56 providing the rotational torque necessary to operated the wrench. An upper ball bearing 66 is drivingly abutted between the housing 20 and the hub 58 and a lower ball bearing 68 is positioned on the opposite end of the hub 58, providing a reduced friction interface. The bearings 66 and 68 are preferably the multiball type, either selfcontained with retainers and seals providing a lifetime supply of grease, or may be the open type retained between structural members with separate or integral races, as shown in FIG. 6. Either type of bearing will function in the invention with equal ease. This arrangement allows the hub 58 to rotate freely inbetween. In order to hold the hub 58 into place in the housing 20, a retaining collar 70 is provided with a separate bearing race 72. The collar 70 is a close tolerance fit with the housing 20 in the socket enclosing portion 28 and acts as a structural keeper containing the linear or rotational thrust from either side of the hub 58.

A separate removable socket 74 is slidingly interfaced into the female splined hollow 60 of the hub 58. The socket, therefore, has a male spine 76 on the outside for this purpose, and a female aperture 78 the shape to receive objects embraced thereunto, such as a hex nut or head of a bolt. This socket 74 is configured to fit the particular head of the workpiece and, therefore, is provided in matched sets ranging from small to large, as illustrated proportionally in FIGS. 3 and 4. A bore 80 is provided in these sockets 74 that allows the threaded portion of the workpiece to penetrate completely through achieving the inherent utility of the socket wrench.

An accessory to this invention is illustrated in FIG. 5 in the form of an adapter socket, which has the same male spline 76 on the upper portion of the socket, but instead of having a bore therethrough, it is solid and contains a shoulder to interface with the hub 58. A square stud 84 extends below the shoulder and is configured the same size as conventional hand operated wrenches, such as the so-called $\frac{3}{8}$, $\frac{1}{2}$, or $\frac{3}{4}$-inch drive. This accessory then allows the wrench to be used with conventional sockets in a normal manner, furthering the utility of the invention.

The rotary socket wrench is provided with a variable resistance switch 86, well known in the art, that is located within the handle 22 of the housing 20 in the proximity of the users forefinger. This device provides manual control of the speed by varying the amount of pressure exerted upon the switch 86. Further, a reverse/forward switch 88 is also located in the handle 22 of the housing 20, however, it is on the top, accessible to the operators thumb. This switch 88 controls the direction of rotation by connecting the appropriate winding combination of the electric motor 30.

The operation of the invention is obvious, as the desired socket 74 is inserted into the hub 58 and interfaced with the workpiece. Power is supplied through a conventional cord and plug 90 and the direction of rotation is selected by the switch 88. The wrench is energized by depressing switch 86 and the socket 74 rotates the workpiece.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. An electrically powered socket wrench for imparting rotational torque to objects embraced thereunto comprising:

(a) a structural housing with a handle for enclosing and protecting elements contained within;

(b) an electric motor having a toothed gear shaft converting electrical energy into rotational torque on said shaft, the motor disposed within said housing, parallel with said handle, providing the motivational force for the wrench;

(c) a drive gear cluster with an integral drive shaft located within said housing, said cluster having;

a first bearing on one end of said drive shaft retained by said housing for reducing the rotational friction of the drive shaft, a first drive gear retained on said drive shaft meshingly interfaced with said toothed motor gear shaft transmitting the rotational torque from the motor to the drive shaft, further having a diameter larger than that of the motor gear, therefore decreasing the speed of the drive shaft relative to the motor, a second drive gear retained on said drive shaft contiguous with said first drive gear and of a relatively smaller diameter for additionally reducing the rotational speed of the motor, a second bearing on the other end of said drive shaft also retained by said housing for decreasing the rotational friction of the shaft, (d) a driven gear train with an integral driven shaft within said housing said train having;

a third bearing on one end of said driven shaft retained by said housing for reducing the rotational friction of the shaft, a driven gear retained on the driven shaft in alignment and meshed with said second drive gear transmitting the motor rotational torque to the driven shaft, said driven gear of a relatively larger diameter than the first drive gear, thereby further decreasing the rotational speed of the driven shaft, a fourth bearing on the driven shaft in close proximity to the driven gear retained by said housing the reducing the rotational friction of the shaft, and, a drive beveled gear disposed upon the end of the driven shaft for transmitting the rotational torque at a right angle to the driven shaft and at a slower speed, (e) a socket retaining geared hub disposed within said housing at a right angle to said motor, the hub having a female splined hollow therethrough, with a driven beveled geared first end and a recessed shoulder on the second end, the first end matingly engaging said bevel gear providing the rotational drive from the motor through the drive gear cluster and driven gear train, the hub further having a bearing race cavity between the geared first end and the splined hollow, (f) an upper ball bearing drivingly abutted between said housing and said hub, also a lower ball bearing positioned on the second end of the hub defining a reduced friction interface allowing the hub to rotate freely therebetween, (g) a retaining collar having a separate bearing race positioned tightly into said housing directly beneath said hub second end retaining the hub between the ball bearings providing a structural keeper containing rotational or linear thrust from either the first or second end of the hub; and, (h) a removable socket having a male splined exterior configured to slidingly engage with the female splined hollow of the hub in a removable manner, the socket having a shape to receive objects embraced thereunto, such as a hex nut or head of a bolt, allowing the wrench to rotate the object in a given direction as powered by the rotational torque of the electric motor.

2. The socket wrench as recited in claim 1 wherein said structural housing further comprises;

(a) said handle portion conforming to the shape of ones hand of a form for conveniently grasping, (b) a motor retaining portion connected on one end integral with the handle in a parallel juxtapositioned relationship thereunto, having a hollow within receptive to said electric motor, (c) a gear confining area extending from the motor retaining portion to protect rotating elements housed within, and, (d) a socket enclosing portion at right angles to the gear confining area integrally connected thereunto defining a mechanical structure for supporting the driven portions of said wrench.

3. The socket wrench as recited in claim 1 wherein said electric motor further comprises an integral reversible winding allowing the motor to operate in either clockwise or counterclockwise direction in order to install or remove the objects embraced by the wrench.

4. The socket wrench as recited in claim 1 wherein said electric motor further comprises a variable speed characteristic such that the motor speed is adjustable over a full range of speed changing the torque capabilities of the motor simultaneous thereunto.

5. The socket wrench as recited in claim 4 further comprising a variable resistance switch disposed within said housing, providing manual control of the speed by the amount of pressure exerted upon the switch.

6. The socket wrench as recited in claim 1 further comprising a reverse/forward switch disposed within said housing providing manual control of the direction of rotation by connecting the appropriate winding combination to said electric motor.

7. The socket wrench as recited in claim 1 wherein said socket further comprises a bore therethrough and a geometrically shaped cavity corresponding in reverse image to said objects embraced thereunto, allowing the wrench to be positioned over an object, such as a nut, and rotate this object along a mating threaded track in an infinite manner, such as running threads or the shank of a bolt without bottoming on the socket or wrench.

8. The socket wrench as recited in claim 1 further comprising a socket adapter having a male spline interfacing with said socket retaining geared hub in place of said socket, and a square stud extending below the wrench, allowing the use of conventional hand operated drive sockets in combination with the wrench.

* * * * *